United States Patent [19]

Garron et al.

[11] 4,214,543

[45] Jul. 29, 1980

[54] ELECTRONICALLY CONTROLLED TOP FEED ARRANGEMENT FOR A SEWING MACHINE

[75] Inventors: Stephen A. Garron, Elizabeth; Robert Sedlatschek, Bridgewater; John J. Sudano, Paterson, all of N.J.

[73] Assignee: The Singer Company, Stamford, Conn.

[21] Appl. No.: 55,136

[22] Filed: Jul. 5, 1979

[51] Int. Cl.[2] ..... D05B 27/04

[52] U.S. Cl. ..... 112/320; 112/158 E

[58] Field of Search ..... 112/320, 314, 158 E, 112/121.11, 311, 313

[56] References Cited

U.S. PATENT DOCUMENTS

| | | | |
|---|---|---|---|
| 3,099,974 | 8/1963 | Chudner | 112/311 |
| 3,162,158 | 12/1964 | Chudner | 112/311 |
| 3,368,507 | 2/1968 | Orth | 112/311 |
| 3,730,117 | 5/1973 | Ritter et al. | 112/320 |
| 3,808,995 | 5/1974 | Dobner et al. | 112/313 |
| 3,867,889 | 2/1975 | Conner, Jr. | 112/121.11 |
| 3,872,808 | 3/1975 | Wurst | 112/158 E |
| 3,935,826 | 2/1976 | Nicolay | 112/320 |
| 4,120,254 | 10/1978 | Herr et al. | 112/158 E |

FOREIGN PATENT DOCUMENTS

| | | | |
|---|---|---|---|
| 606577 | 11/1978 | Switzerland | 112/158 E |

*Primary Examiner*—Peter Nerbun

*Attorney, Agent, or Firm*—David L. Davis; Robert E. Smith; Edward L. Bell

[57] ABSTRACT

A sewing machine is provided with an electronically controlled top feed arrangement wherein an upper feed dog and a presser foot are adapted to alternately apply and relieve pressure upon a work fabric, the upper feed dog and the presser foot being oppositely phased with respect to each other. A linear actuator is coupled to reciprocate the upper feed dog along a feed line and a memory stores feed data including for each stitch a first data portion for controlling the feed stroke of the upper feed dog and a second data portion for controlling the return stroke of the upper feed dog.

3 Claims, 3 Drawing Figures

ELECTRONICALLY CONTROLLED TOP FEED ARRANGEMENT FOR A SEWING MACHINE

DESCRIPTION

Background of the Invention

This invention relates to sewing machines and, more particularly, to an electronically controlled direct drive top feed arrangement for a sewing machine.

In a conventional sewing machine, movement of the work fabric being sewn is effected by cooperation between a presser foot and a feed dog. The work fabric is urged against a work supporting surface by the presser foot, which is attached to a pressure applying presser bar. The underside of the presser foot, which contacts the work fabric, is a generally smooth surface having a low coefficient of friction. On the other hand, the feed dog has a high coefficient of friction and is located in a throat passage which opens through the work support. The feed dog is operated by a mechanism which effects a "four motion" action of the feed dog to produce a feed advance and return movement thereof. During the feed advance movement of the feed dog, the feed dog engages the lower surface of the work fabric to advance the work fabric in the direction of movement of the feed dog. The purpose of the presser foot is to apply pressure to the work fabric so that there is frictional engagement of the work fabric by the feed dog.

The force required to feed fabric in a conventional sewing machine can be roughly approximated by the following equation:

$$F = D + W + \frac{u_1 P}{1 - u_1 \tan\theta} + \frac{P\tan\theta}{1 - u_1 \tan\theta}$$

where D is the inertia force of the fabric (related to sewing speed, type and amount of material), W is the weight of the material hanging over the front edge of the machine, $u_1$ is the coefficient of friction between the fabric and the presser foot, P is the presser bar pressure and $\theta$ is the angle of the presser foot relative to the horizontal caused by abrupt changes in ply thickness.

It is desirable to minimize the force F because it causes a reaction torque, proportional to F, to be developed on the stitch length control element which can reduce the actual stitch length to below specified values. In addition, if the magnitude of the force F exceeds the available feeding force, $u_2P$, where $u_2$ is the coefficient of friction between the work fabric and the feed dog, slippage will result and the fabric will not be transported. Conventional techniques attempt to minimize the force F by reducing $u_1$, the coefficient of friction between the work fabric and the presser foot, and the angle $\theta$. Experiments have determined that values of $u_1$ range between 0.11 and 0.2. The presser bar pressure P can be reduced only to certain values, approximately 4 pounds, because further reductions only reduce the available feeding force $u_2P$. Assuming $\theta=0$, the third term of the foregoing equation therefore has a value of up to approximately 0.8 pounds. The maximum value of $\theta$ is about 12° and thus the fourth term of the foregoing equation can have a value of up to about 0.8 pounds. Thus, the sum of the last terms in the foregoing equation can be up to about 1.6 pounds, which can be a very significant portion of the total required feeding force.

It is therefore an object of this invention to provide an improved feed system.

SUMMARY OF THE INVENTION

The foregoing and additional objects are attained in accordance with the principles of this invention by providing an electronically controlled top feed arrangement which may be utilized either alone or as an adjunct to the conventional sewing machine feed arrangement. The top feed arrangement includes an upper feed dog adapted to alternately apply and relieve pressure upon a work fabric, the application of pressure by the upper feed dog occurring when the sewing machine needle is out of the work fabric, and a presser foot adapted to alternately apply and relieve pressure upon the work fabric, the relief of pressure by the presser foot occurring when the upper feed dog is applying pressure to the work fabric. An actuator is coupled to reciprocate the upper feed dog along a feed line in response to control signals applied thereto. A memory is provided for storing feed data including for each stitch a first data portion for the feed stroke and a second data portion for the return stroke. Means are provided for extracting from the memory the feed data and utilizing the feed data to provide control signals for the actuator in the proper timing during the formation of a stitch.

DESCRIPTION OF THE DRAWINGS

The foregoing will be more readily apparent upon reading the following description in conjunction with the drawings wherein.

DETAILED DESCRIPTION OF THE DRAWINGS

Figure 1:
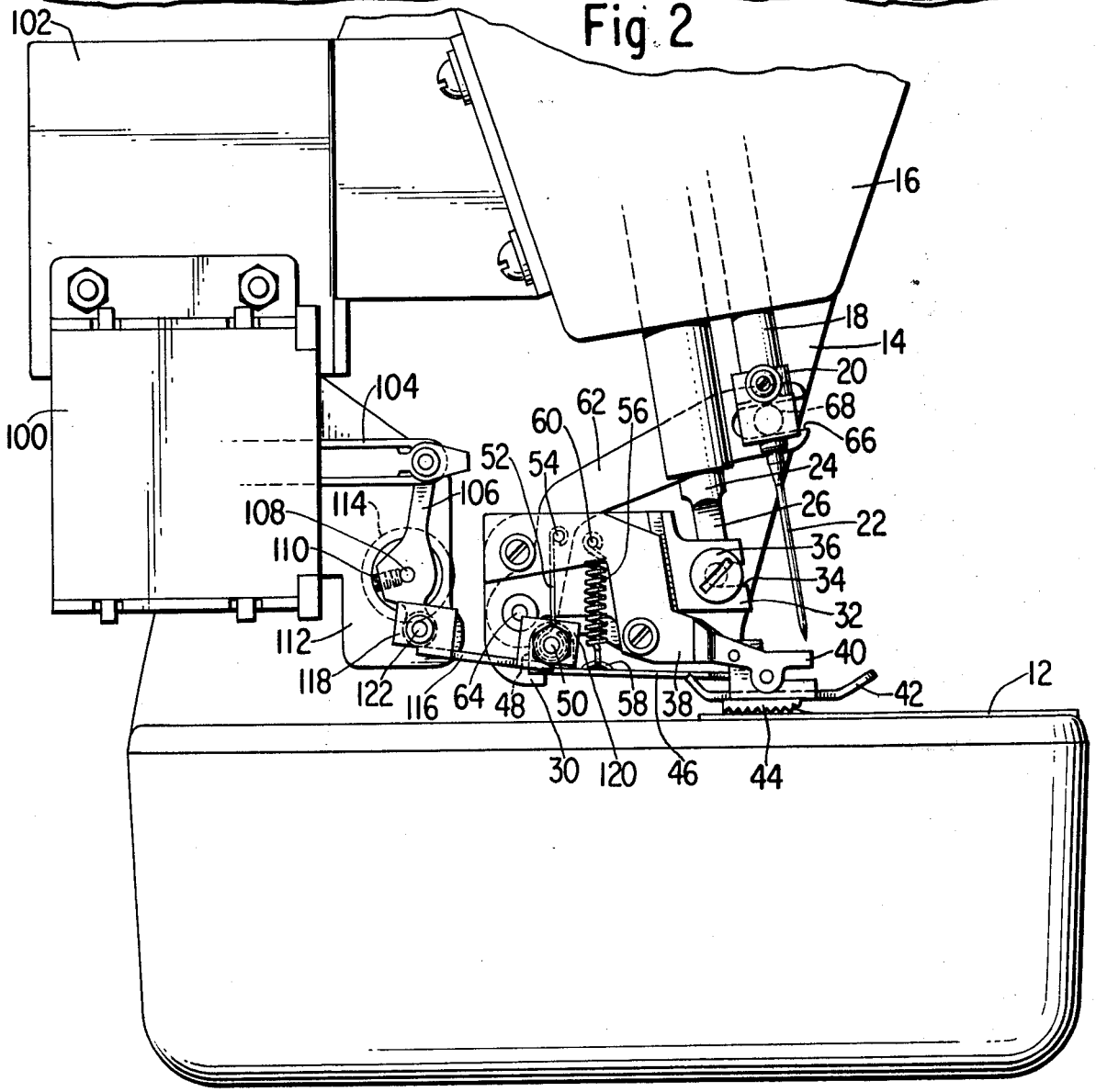
FIG. 1 is an end elevation view of part of a sewing machine showing mounted thereon a portion of an illustrative top feed arrangement constructed in accordance with the principles of this invention.

Referring now to the drawings, and in particular to FIG. 1 thereof, shown therein is part of a sewing machine having a work supporting surface 12 from which rises a standard 14 supporting a bracket arm 16 overhanging the work supporting surface 12. Journalled for endwise reciprocation in the bracket arm is a needle bar 18 to which a needle clamp 20 is secured for fastening a needle 22 thereon. Also endwise slidable in the bracket arm 16 is a presser bar 24 formed with a slabbed seat 26 of the conventional type adapted to accomodate a presser foot. The presser bar 24 is preferably spring biased downwardly as is conventional in sewing machine construction.

In accordance with the principles of this invention, the top feed arrangement is illustratively implemented by coupling an even feed device controlled by a linear motor to the needle bar 18 and the presser bar 24. The even feed device is illustratively of the type fully described in U.S. Pat. No. 3,730,117, the contents of which are hereby incorporated by reference herein. The even feed device includes a support block 30 having a shank 32 formed complemental to the slabbed seat 26 on the presser bar 24 and including a notch 34 to accomodate a fastening screw 36 by which the attachment may be secured to the presser bar 24 of the sewing machine. A pair of side plates 38, only one of which is shown, are located one at each side of the support block 30 and each is formed with a forwardly extending arm 40, between which a presser foot 42 is pivotally supported. The presser foot 42 is therefore supported directly on the sewing machine presser bar 24 by the integral support block 30 and the side plates 38 which are fastened permanently thereon. The presser foot 42 is formed with a conventional needle accomodating aperture and also with longitudinal slots accomodating an upper feed dog 44.

The upper feed dog 44 is secured at the forward extremity of an elongated rigid bar 46. The bar 46 at the extremity opposite the upper feed dog 44 is formed with upturned tabs 48 sustaining a pivot pin 50 by which the bar 46 is pivotally supported on the depending extremity of a link 52 mounted for pivotal motion on a post 54 of the support block 30. The pivot pin 50 provides the only support for the upper feed dog 44 and the bar 46 by which the upper feed dog 44 is carried. A light coil spring 56 is preferably arranged in tension between a tab 58 on the bar 46 and a post 60 on the support block 30, providing an upward bias for the upper feed dog 44.

An operating lever 62 is pivotally sustained on a fulcrum pin 64 on the support block 30. The operating lever 62 is bifurcated as at 66 at its free extremity to embrace a portion of the clamp screw 68 of the needle clamp 20 on the sewing machine needle bar 18. As described in the referenced U.S. Pat. No. 3,730,117, the lever 62 is operatively coupled to the bar 46 so that during each upstroke of the sewing machine needle bar 18, the upper feed dog 44 is urged downwardly into engagement with the work fabric on the support surface 12. At the same time, the presser foot 42 is elevated. When the needle bar 18 is reciprocated downwardly toward the work fabric, the operating lever 62 moves downwardly and allows the upper feed dog 42 to shift upwardly in response to the light return spring 56. At the same time, the presser foot 42 is lowered into engagement with the work fabric. Thus, in response to reciprocation of the needle bar 18, the upper feed dog 44 alternately applies and relieves pressure upon the work fabric, the application of pressure by the upper feed dog 44 occurring when the sewing machine needle 22 is out of the work fabric, and the presser foot 42 alternately applies and relieves pressure upon the work fabric, the relief of pressure by the presser foot 42 occurring when the upper feed dog 44 is applying pressure to the work fabric.

To provide work transporting motion to the upper feed dog 44, in accordance with the principles of this invention, an actuator 100 is coupled to the bar 46. Illustratively, the actuator 100 is a linear motor of the type described in U.S. Pat. No. 4,016,441, the contents of which are hereby incorporated by reference herein. The linear motor 100 is mounted on a bracket 102 attached to the bracket arm 16 of the sewing machine. The linear motor 100 includes a connecting rod 104 extending outwardly from the linear motor 100. The connecting arm 104 is coupled to a lever arm 106 which is connected to a shaft 108 by means of a set screw 110. The shaft 108 acts as a pivot point for the lever arm 106 and is journalled for rotation in a suitable bearing member (not shown) mounted on the plate 112. A rotary potentiometer 114 has its control element connected to the shaft 108 so that pivotal motion of the lever arm 116 is converted to rotary motion of the control element of the potentiometer 114. The potentiometer 114 is thus used to provide electrical signals indicative of the position of the lever arm 106. To couple the lever arm 106 with the bar 46 connected to the upper feed dog 44, there is provided a rigid bar 116 formed with upturned tabs 118 and 120 at the extremities thereof. The upturned tab 118 is coupled to the lever arm 106 by a pivot pin 122 and the upturned tab 120 is connected to the bar 46 by the pivot pin 50. Thus, when the connecting arm 104 of the linear motor 100 is extended outwardly (toward the right as viewed in FIG. 1) from the linear motor 104, the upper feed dog 44 is pulled to the left and when the connecting arm 104 is moved to the left, the upper feed dog 44 is moved to the right.

As will be described in more detail hereinafter, in accordance with the present invention, control signals are applied to the linear motor 100 to cause it to execute during each stitch a feed stroke and a return stroke. The feed stroke occurs when the needle is up and the upper feed dog 44 is engaged with the work fabric and the return stroke occurs when the needle is down and the presser foot 42 is engaged with the work fabric. The feed stroke may be in either direction, so as to provide for forward or reverse feeding of the work fabric, and the return stroke is of the same magnitude, but of opposite direction to, the feed stroke.

Figure 2:
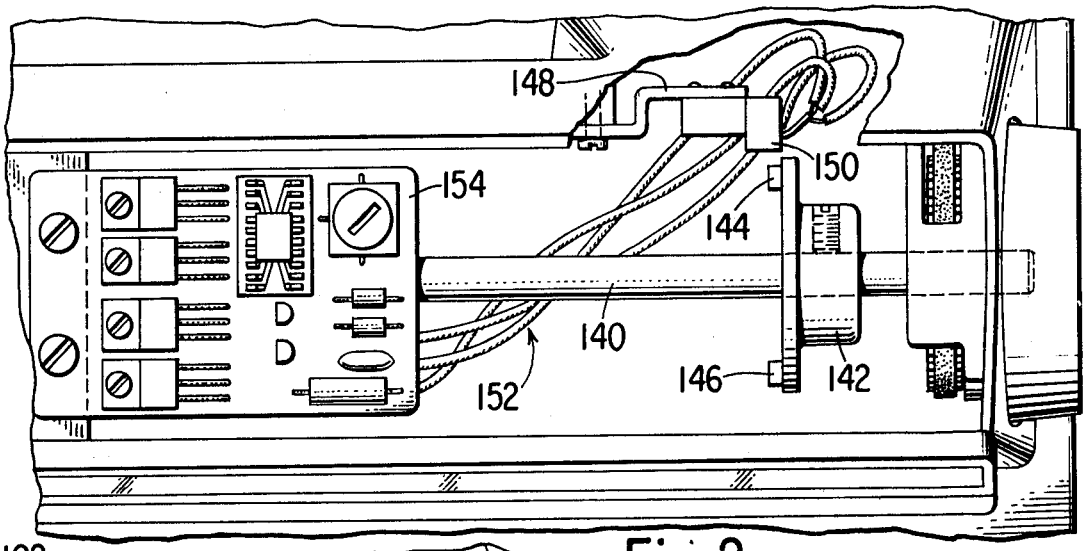
FIG. 2 is a cutaway top plan view of a portion of the sewing machine of FIG. 1 showing the remainder of the arrangement constructed in accordance with the principles of this invention.

In order to generate the appropriate signals for controlling the linear motor 100, there is mounted on the arm shaft 140 (FIG. 2) of the sewing machine a wheel 142 having affixed thereon a pair of magnets 144, 146. Mounted to the sewing machine frame via a bracket 148 is a Hall effect sensing device 150 which, as is well known in the art, provides an output signal when either of the magnets 144, 146 passes in close proximity thereto. These signals are coupled via the leads 152 to appropriate electronic circuitry mounted on the board 154, which circuitry is utilized, in a manner to be described, for generating the appropriate control signals for the linear motor 100. The magnet 144 is utilized to generate a signal for controlling the feed stroke of the linear motor 100 and is arranged to pass the sensor 150 when the needle 22 is near the top of its motion. The magnet 146 is utilized to generate a signal for the return stroke of the linear motor 100 and is arranged to pass the sensor 150 when the needle 22 is penetrating the work fabric.

Figure 3:
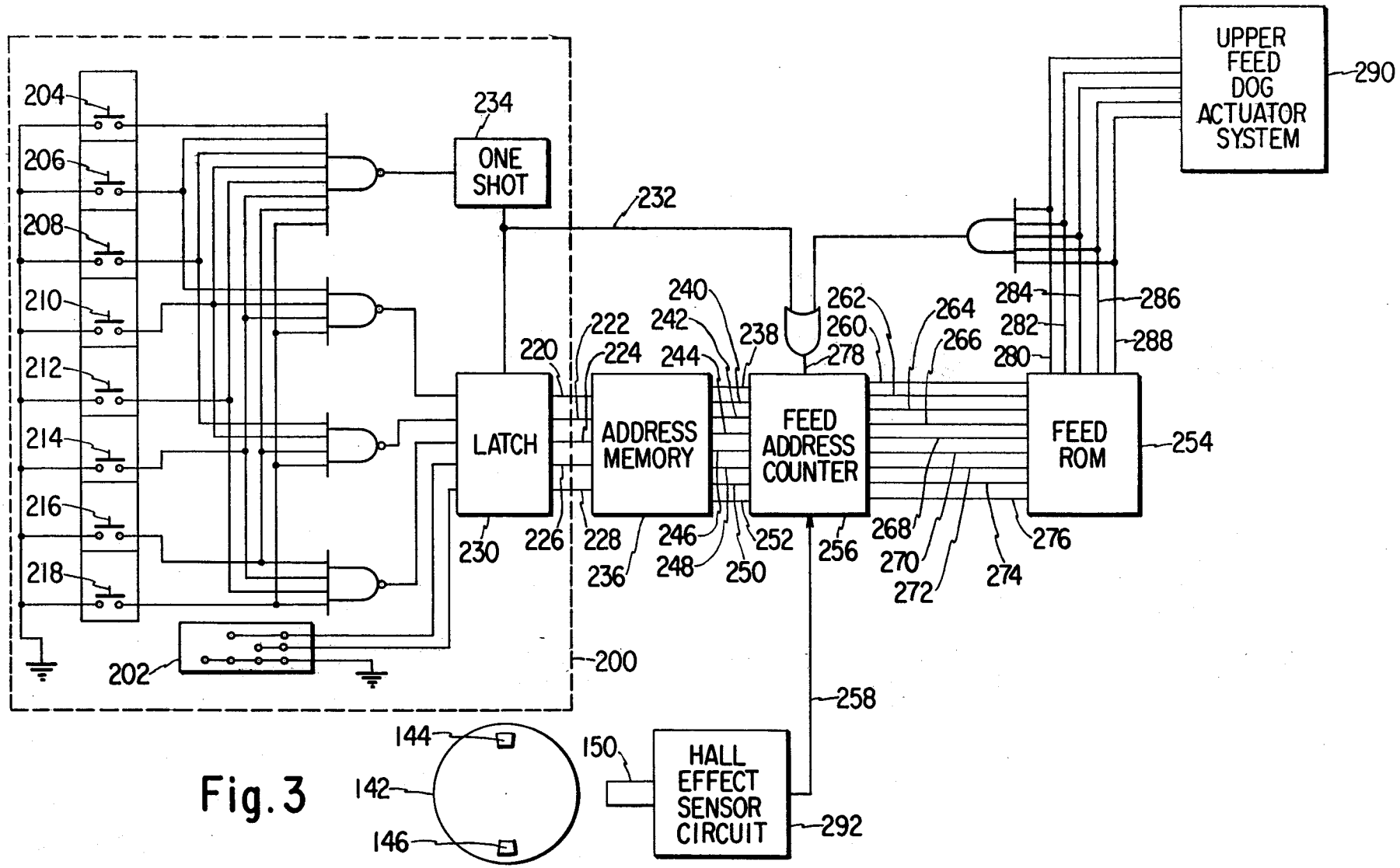
FIG. 3 is a block schematic diagram showing illustrative control circuitry for operating the arrangement shown in FIGS. 1 and 2.

Referring now to FIG. 3, shown therein is a block schematic diagram of illustrative control circuitry for operating the arrangement described above. The circuitry shown in FIG. 3 is substantially the same as that disclosed in U.S. Pat. No. 3,872,808, and insofar as it pertains to an understanding of the present invention, the disclosure of this patent is hereby incorporated by reference herein. This circuitry has been modified to perform a top feed function, as will be apparent from the following discussion. The pattern selector arrangement 200, depending upon the setting of a switch 202 and depending upon which pattern selection button 204, 206, 208, 210, 212, 214, 216 or 218 is depressed, causes a selected digital code signal to appear continuously on output lines 220, 222, 224, 226 and 228 from the latch 230 and also causes a pulse to be generated on the line 232 from the one shot circuit 234. In the address memory 236, the digital code signal on the lines 220 to 228 results in an output on the lines 238, 240, 242, 244, 246, 248, 250 and 252, which continuously defines the starting word address of a group of consecutive word addresses in the feed ROM 254. The feed address counter 256 is responsive to pulses on the line 258 consecutively to increase the address appearing on the lines 260, 262, 264, 266, 268, 270, 272, 274 and 276 leading to the ROM 254. A pulse on the line 278 resets the counter 256 to the starting word address appearing on the lines 238 to 252. This pulse on the lead 278 is caused either by a pulse on the line 232 resulting from selection of a new pattern or upon the appearance of a special end of pattern code word on the output lines 280, 282, 284, 286 and 288 from the ROM 254. The output lines 280 to 288 from the ROM 254 are provided as input signals to the upper feed dog actuator system 290. Illustratively, the actuator system 290 is of the type disclosed in U.S. Pat. No. 3,984,745, the contents of which are hereby incorporated by reference herein. The actuator system 290 includes, and provides the signals for controlling, the linear motor 100 (FIG. 1) to reciprocate the upper feed dog 44 for the feed and return strokes thereof.

As described above, the actuator system 290 provides two strokes per stitch of the linear motor 100. This is accomplished by providing two pulses per stitch on the line 258 to increment the feed address counter 256 twice per stitch. Accordingly, the feed ROM 254 contains two pieces of feed data for each stitch. The two pulses per stitch on the line 258 are generated by the Hall effect sensor circuit 292 which responds to the magnets 144, 146 passing in close proximity to the sensor 150 to generate the aforementioned pulses. To provide for a full patterning capability of the sewing machine, although not a part of the present invention, there would be provided for the needle jogging mechanism a parallel address counter, ROM and actuator system which would respond to only a single timing pulse per stitch, as disclosed in the U.S. Pat. No. 3,984,745.

Experimental results have been obtained by sewing on 10 ounce denim and comparing stitch length when utilizing a conventional bottom feed and general purpose presser foot and when utilizing a top feed arrangement as described herein. Sewing was performed on multiple plies and over hurdles from 2 to 6 plies and from 2 to 10 plies. The following results were obtained:

| | Conventional Bottom Feed and General Purpose Presser Foot (inches per stitch) | Described Top Arrangement (inches per stitch) |
|---|---|---|
| 2 Plies | .137 | .137 |
| 6 Plies | .117 | .130 |
| 10 Plies | .100 | .113 |
| 2 to 6 | Short Stitches | Climbs Well |
| 2 to 10 | Stalls | Climbs Well |

It is seen that the stitch length loss on six plies is reduced by about 67% and on ten plies by about 33% utilizing the described top feed arrangement as compared to a conventional feed arrangement. Additionally, there is considerable improvement in climbing over ply change hurdles.

Accordingly, there has been described an electronically controlled direct drive top feed arrangement for a sewing machine. It is understood that the above-described embodiment is merely illustrative of the application of the principles of this invention. Numerous other embodiments may be devised by those skilled in the art without departing from the spririt and scope of this invention, as defined by the appended claims. For example, although the top feed arrangement as described is utilized as the sole work transporting mechanism, it is contemplated that such a top feed arrangement could be utilized in cooperation with a conventional bottom feed mechanism.

We claim:

1. An electronically controlled top feed arrangement for a sewing machine comprising:

memory means for storing feed data, said feed data including for each stitch a first data portion for a feed stroke and a second data portion for a return stroke;

an upper feed dog adapted to alternately apply and relieve pressure upon a work fabric, the application of pressure occurring when the sewing machine needle is out of said work fabric;

a presser foot adapted to alternately apply and relieve pressure upon said work fabric, the relief of pressure occurring when said upper feed dog is applying pressure to said work fabric;

timing means for supplying a first timing signal during the period when the sewing machine needle is out of said work fabric and a second timing signal during the period when the sewing machine needle is penetrating said work fabric;

means operative during formation of a stitch for extracting from said memory means said feed data for said stitch;

an actuator coupled to reciprocate said upper feed dog along a feed line in response to control signals applied thereto; and control means responsive to said first timing signal for utilizing said extracted first data portion to provide a control signal for said actuator so as to move said upper feed dog for said feed stroke, and responsive to said second timing signal for utilizing said extracted second data portion to provide a control signal for said actuator so as to move said upper feed dog for said return stroke.

2. The arrangement according to claim 1 wherein said timing means includes a Hall effect sensor and first and second magnets adapted to pass in close proximity to said hall effect sensor in timed relation in the operation of said sewing machine.

3. The arrangement according to claim 1 wherein said actuator includes a linear motor.

* * * * *